US008540389B2

(12) United States Patent
Tang

(10) Patent No.: US 8,540,389 B2
(45) Date of Patent: Sep. 24, 2013

(54) GLOVE AND AN ILLUMINATING INDICATING SYSTEM

(76) Inventor: Juinn Hao Tang, Welwyn Garden City (GB)

( * ) Notice: Subject to any disclaimer, the term of this patent is extended or adjusted under 35 U.S.C. 154(b) by 462 days.

(21) Appl. No.: 12/899,107

(22) Filed: Oct. 6, 2010

(65) Prior Publication Data

US 2011/0078842 A1 Apr. 7, 2011

(51) Int. Cl.
*F21V 21/08* (2006.01)
*A41D 19/00* (2006.01)

(52) U.S. Cl.
USPC ..... 362/103; 2/160

(58) Field of Classification Search
USPC ..... 362/103; 2/160, 158, 161.1, 161.6, 2/159, 153, 907, 910
See application file for complete search history.

(56) References Cited

U.S. PATENT DOCUMENTS

| | | | | | |
|---|---|---|---|---|---|
| 1,402,609 | A * | 1/1922 | Hodous | 362/103 |
| 1,496,484 | A * | 6/1924 | Monaco | 340/321 |
| 1,504,980 | A * | 8/1924 | Schultz | 340/321 |
| 1,531,373 | A * | 3/1925 | Bigelow | 340/321 |
| 3,638,011 | A * | 1/1972 | Bain et al. | 362/103 |
| 5,177,467 | A * | 1/1993 | Chung-Piao | 340/574 |
| 5,673,436 | A * | 10/1997 | Piper | 2/160 |
| 5,675,138 | A * | 10/1997 | La | 235/462.44 |
| 5,907,147 | A * | 5/1999 | La | 235/472.01 |
| 6,006,357 | A * | 12/1999 | Mead | 2/160 |
| 6,592,235 | B1 * | 7/2003 | Mayo | 362/103 |
| 6,709,142 | B2 * | 3/2004 | Gyori | 362/554 |
| 7,946,739 | B2 * | 5/2011 | Shayne | 362/385 |
| 2001/0040550 | A1 * | 11/2001 | Vance et al. | 345/156 |

* cited by examiner

*Primary Examiner* — John A Ward
(74) *Attorney, Agent, or Firm* — E. Victor Indiano; Indiano Law Group, LLC

(57) ABSTRACT

A glove and illuminating indicating system is provided. The system includes a reed switch in the middle finger of the glove, a magnet connected to the thumb of the glove, and a lighting means. The system is configured such that bringing the reed switch and the magnet within a threshold distance from each other causes the reed switch to effect illumination of the lighting means.

18 Claims, 6 Drawing Sheets

GLOVE AND AN ILLUMINATING INDICATING SYSTEM

BACKGROUND OF THE INVENTION

The present invention relates to a glove including digits and an illuminating indicating system. The glove is preferably to be used by a cyclist to act as an indicator when the cyclist makes a hand signal.

GB 420,208 discloses a glove to be used as an indicator having a first contact member attached to the middle finger of the glove, and a second contact member attached to the thumb of the glove. The first and second contact members are both connected to an electric light bulb on the back of the glove. When the first and second contact members are brought into contact with one another, a circuit is completed to effect illumination of the electric light bulb. A problem with this glove is that the contact members will be subject to much wear by being brought into contact with each other. Another problem is that the contact members will need to be kept clean so that dirt does not stop the circuit being completed. If the contact members get wet, such as when the glove is used in the rain, then moisture can accidentally cause the circuit to be completed. Also, moisture and salts can cause the contact members and other metal elements to corrode. Furthermore, the contact members should be of a reasonable size to maximize the chance of positive contact. This means that the contact members should have a shape to match the rounded shape of a finger or thumb tip. If the contact members are made smaller then they can be made to be flatter but this means that the user must be more accurate in bringing the contact members into contact with one another.

SUMMARY OF THE INVENTION

It is an object of the present invention to provide a glove to alleviate at least one of the above-mentioned problems.

According to the present invention there is provided a glove including digits and an illuminating indicating system, the system including a proximity switch connected to one digit of the glove, a proximity switch actuator connected to another digit of the glove, and a lighting means, the system being configured such that bringing the proximity switch and the proximity switch actuator within a threshold distance from each other causes the proximity switch to effect illumination of the lighting means. By the system having a proximity switch and a proximity switch actuator, illumination of the lighting means is effected without the need to have contact members making physical contact. The digits comprise the fingers and thumb of the glove. The glove may be a mitten wherein one digit is the thumb and another digit houses all the fingers of the wearer of the user.

At least part of the illuminating indicating system may be removable from or releasably attached to the glove. All of the illuminating indicating system other than the proximity switch actuator may be removable from or releasably attached to the glove. Preferably, the proximity switch is connected to a finger of the glove and the proximity switch actuator is in, on or connected to the thumb of the glove.

The glove preferably includes a power source for providing power to illuminate the lighting means, and connection means connecting the proximity switch to the lighting means. The power source, the lighting means, the proximity switch and the connection means may form a single unit removably attached to the glove. This unit may be removed from the glove so that the glove can be washed.

The glove may include pocket means which houses at least part of the illuminating indicating system. The pocket means may house the proximity switch and the connection means. The pocket means may house the power source and the lighting means.

The glove may include a casing for holding the power source and the lighting means. The casing may comprise two portions that fit together. The two casing portions may be held together by the pocket means, and this reduces the cost of manufacture and assembly as no fixings such as screws are required. The pocket means may comprise resilient material enabling the two casing portions to be held together by the pocket means when the casing is inserted in the pocket means.

A plurality of the digits may each have a proximity switch or proximity switch actuator holding means so that the proximity switch or proximity switch actuator can be held by any one of the holding means. The holding means may comprise a conduit in a digit of the glove. The proximity switch may be in a said conduit and the conduit may be connected to the pocket means.

Preferably, the proximity switch comprises a reed switch and the proximity switch actuator comprises a magnet.

The threshold distance is preferably not more than 5 cm apart and may not be more than 2 cm apart. The threshold distance may be not more than 15 mm apart.

The illuminating indicating system may include a plurality of proximity switches, the system being configured such that each proximity switch causes the lighting means to illuminate in a different manner, such as a different colour, when said proximity switch is closed. Each proximity switch may be arranged to be located on a different digit.

BRIEF DESCRIPTION OF THE DRAWINGS

Embodiments of the present invention will now be described, by way of example, with reference to the accompanying schematic drawings, in which.

DETAILED DESCRIPTION OF THE INVENTION

Figure 1:
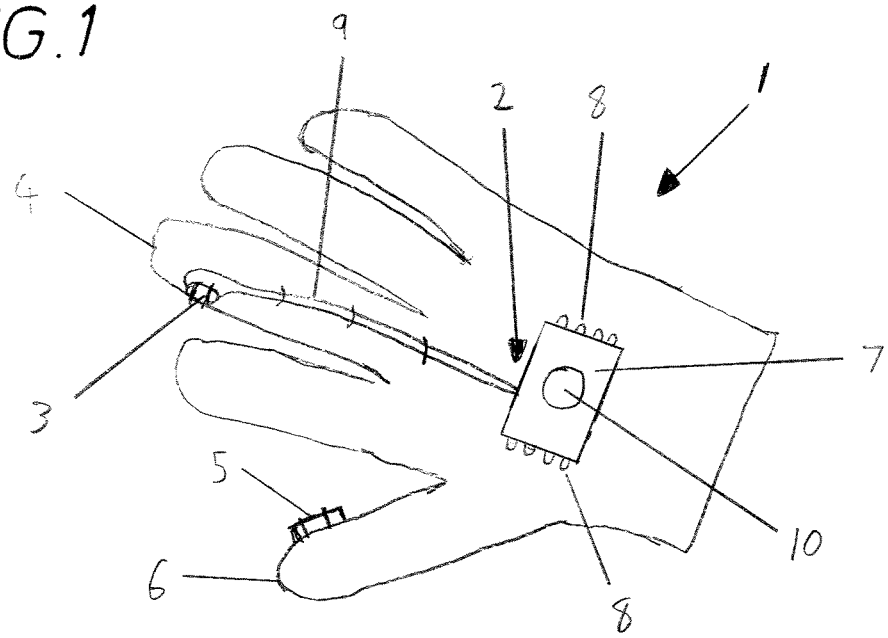
FIG. 1 is a plan view of a glove and an illuminating indicating system in accordance with one embodiment of the invention.

Referring to FIG. 1 of the accompanying drawings, a glove 1 and an illuminating indicating system 2 is provided. The system 2 includes a reed switch 3 strapped to the middle finger 4 of the glove 1, and a magnet 5 strapped to the thumb 6 of the glove 1. A circuit board 7 containing an array of light emitting diodes (LEDs) 8 is located on the back of the glove 1 and the reed switch 3 is connected to the array of LEDs 8 by a pair of wires 9 strapped to the glove 1. A cell battery 10 is located on the circuit board 7 to provide power to illuminate the LEDs 8.

Figure 2:
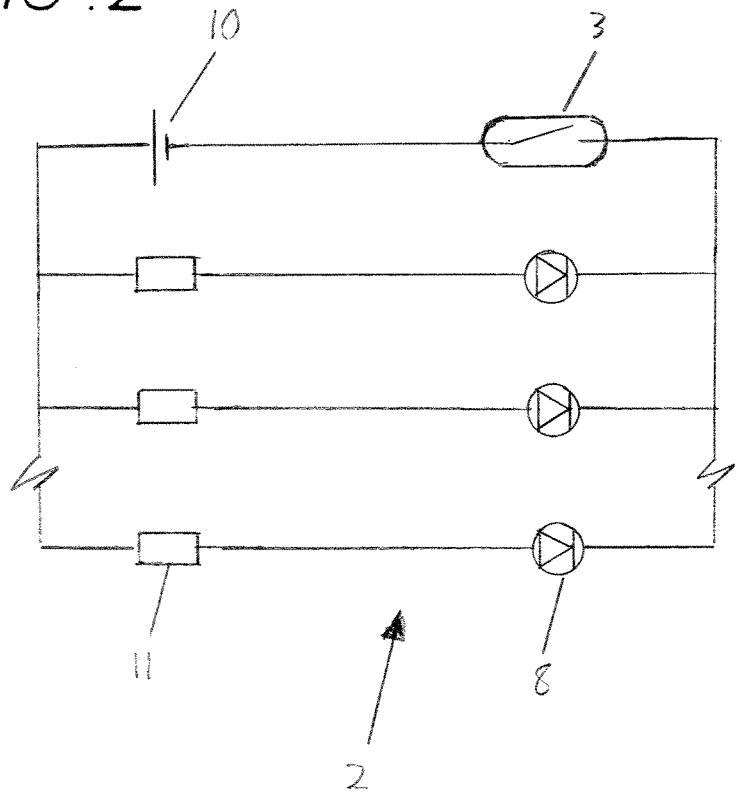
FIG. 2 is a circuit diagram of the illuminating indicating system.

The electrical circuit for the glove 1 is illustrated in FIG. 2 wherein the battery 10 and reed switch 3 are in series. Each LED 8 is connected in parallel to the battery 10 and reed switch 3 and has an accompanying resistor 11. Only three of the LEDs 8 and resistors 11 are shown in the figure.

In use, a user wearing the glove 1 brings his thumb 6 and middle finger 4 towards each other so that when the reed switch 3 and magnet 5 are within a threshold distance from each other, the reed switch 3 is closed causing the LEDs 8 to illuminate. The LEDs 8 preferably produce amber light when illuminated. In order to flash the LEDs 8 the user repeatedly brings his thumb 6 and middle finger 4 towards and away from each other, and the speed of performing this dictates the rate of flashing.

Figure 3:
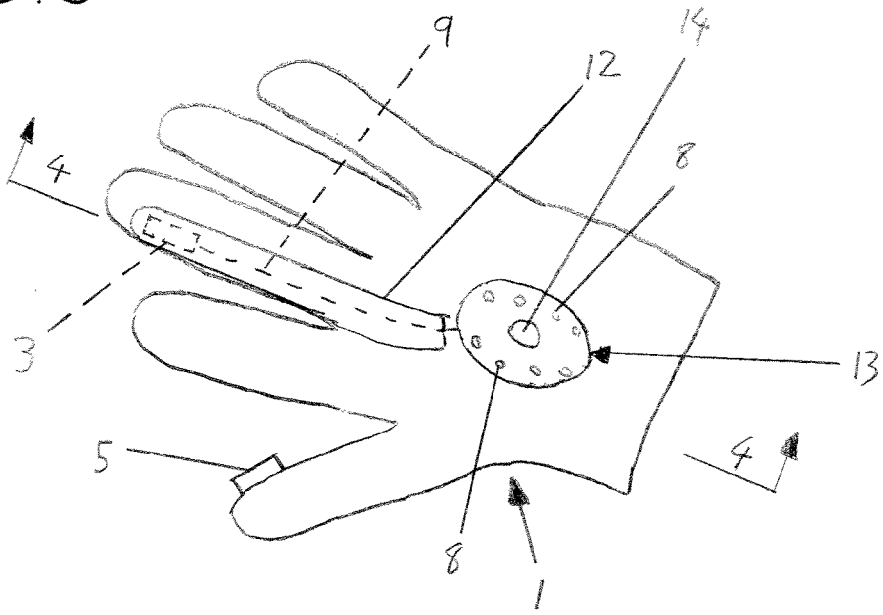
FIG. 3 is a plan view of a modified glove and illuminating indicating system.
Figure 4:
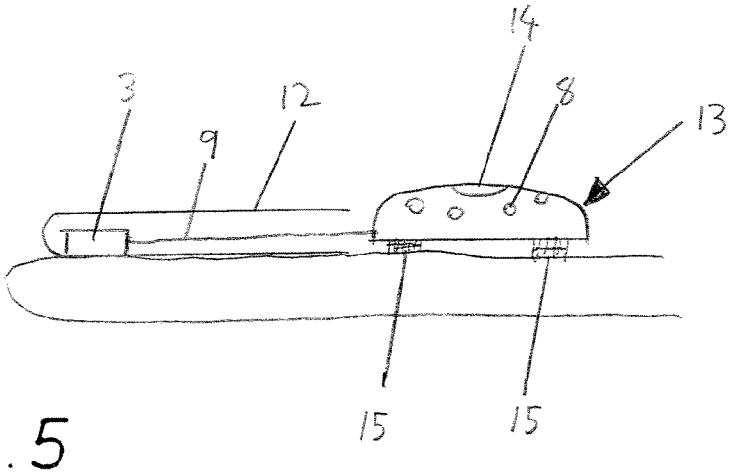
FIG. 4 is a longitudinal sectional view taken along lines 4-4 of FIG. 3.

In a modification illustrated in FIGS. 3 and 4, a flexible tubular passage or pocket 12 is provided along the back of the middle finger 4 of the glove 1 to house the reed switch 3 and the wire connection 9 to the circuit board (not shown). The circuit board and battery (not shown) are held in a protective casing 13 and the LEDs 8 are mounted in the casing 13. A removable cover 14 is provided in the casing 13 for access to the battery and the casing 13 is held by detachable fastening means 15, such as Velcro®, to the back of the glove 1. If the glove 1 is to be washed, the casing 13 containing the circuit board, the LEDs 8 and the battery is removed from the back of the glove 1 and when the casing 13 is removed the connected reed switch 3 is also removed by being pulled out of the tubular pocket 12. The magnet 5 on the glove 1 is not affected by being washed.

Figure 5:
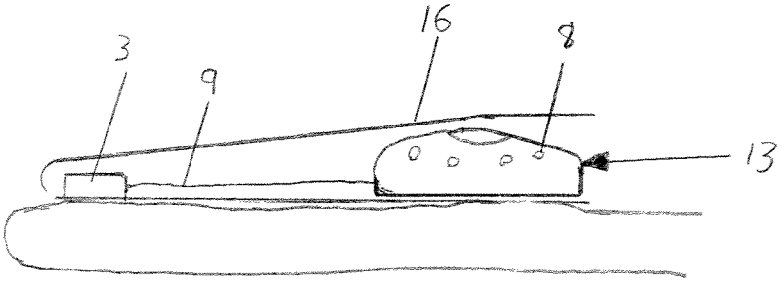
FIG. 5 is a modified view of FIG. 4.

In a modification illustrated in FIG. 5, the pocket 16 extends over the casing 13 and is transparent so that light from the LEDs 8 can be seen.

Figure 6:
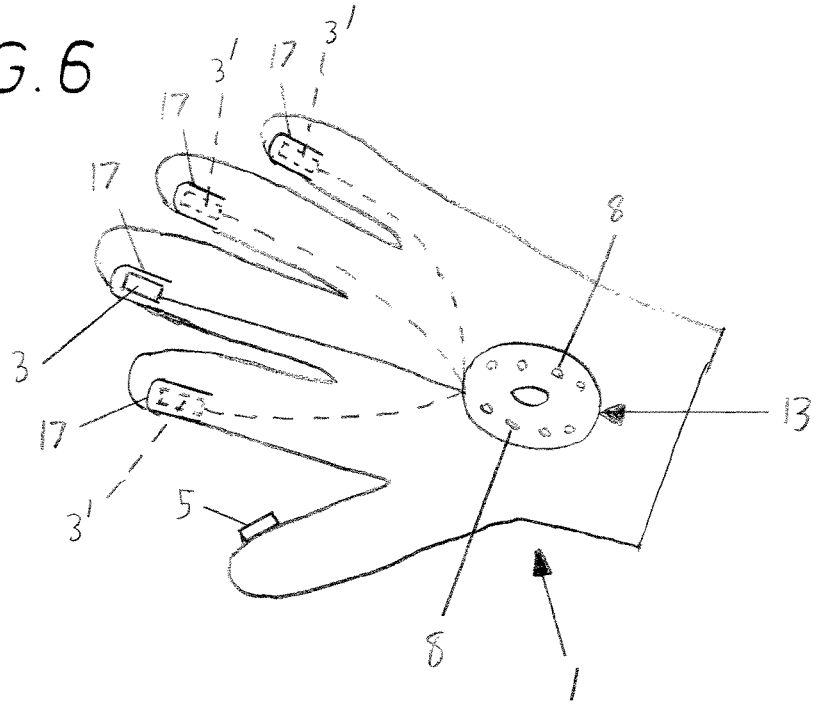
FIG. 6 is a plan view of another modified glove and illuminating indicating system.

In another modification illustrated in FIG. 6, each of the fingers of the glove 1 has a pocket 17 for holding the reed switch 3 so that the user can choose which finger to use to cause the LEDs 8 mounted in the casing 13 to illuminate. One pocket 17 is shown as holding the reed switch 3 and the other pockets 17 shows in dotted line the outline of where the reed switch 3' could be placed.

Figure 7:
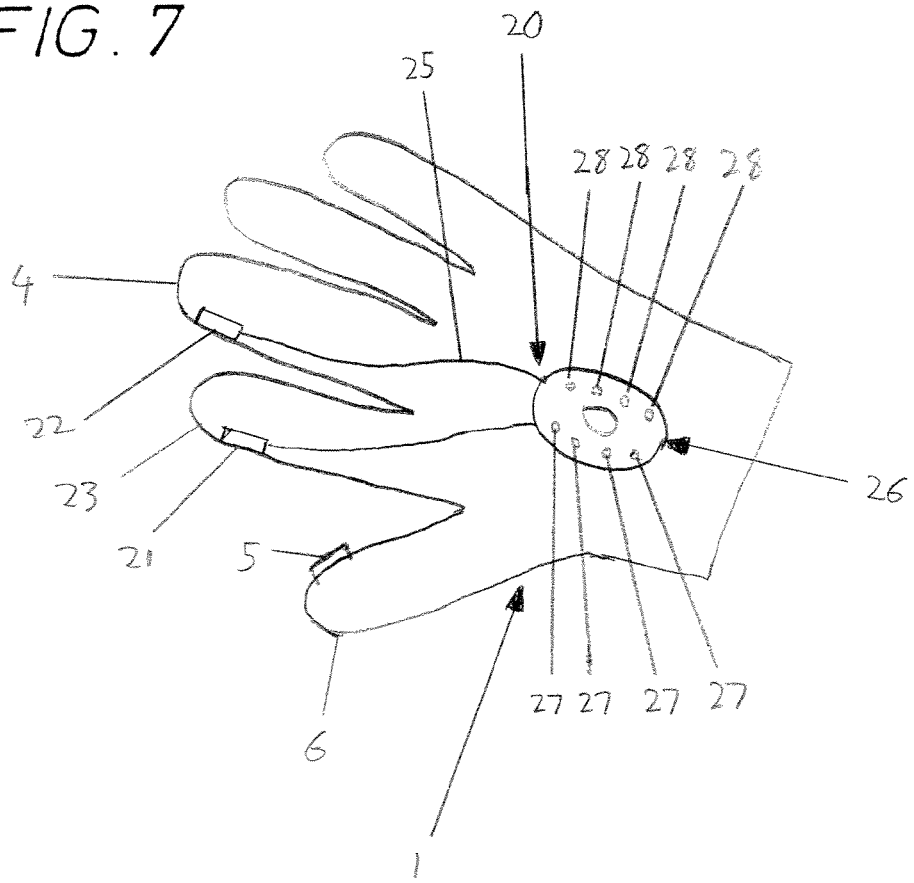
FIG. 7 is a plan view of yet another modified glove and illuminating indicating system.
Figure 8:
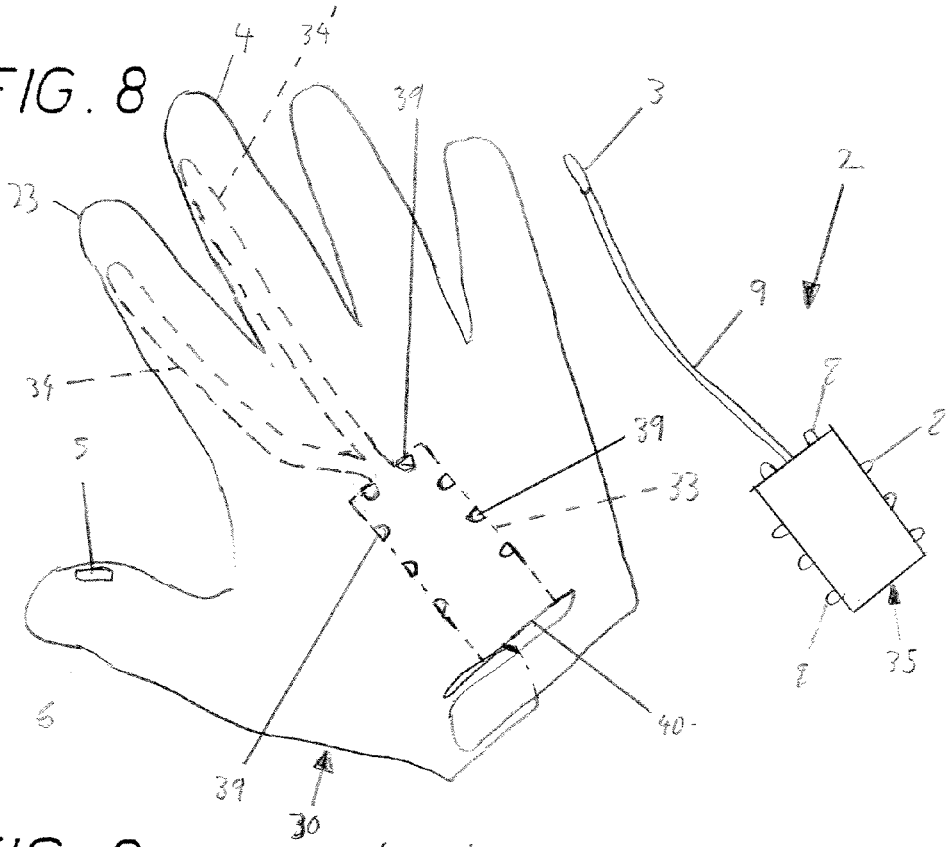
FIG. 8 is a plan view of a further modified glove and illuminating indicating system to be placed in the glove.
Figure 9:
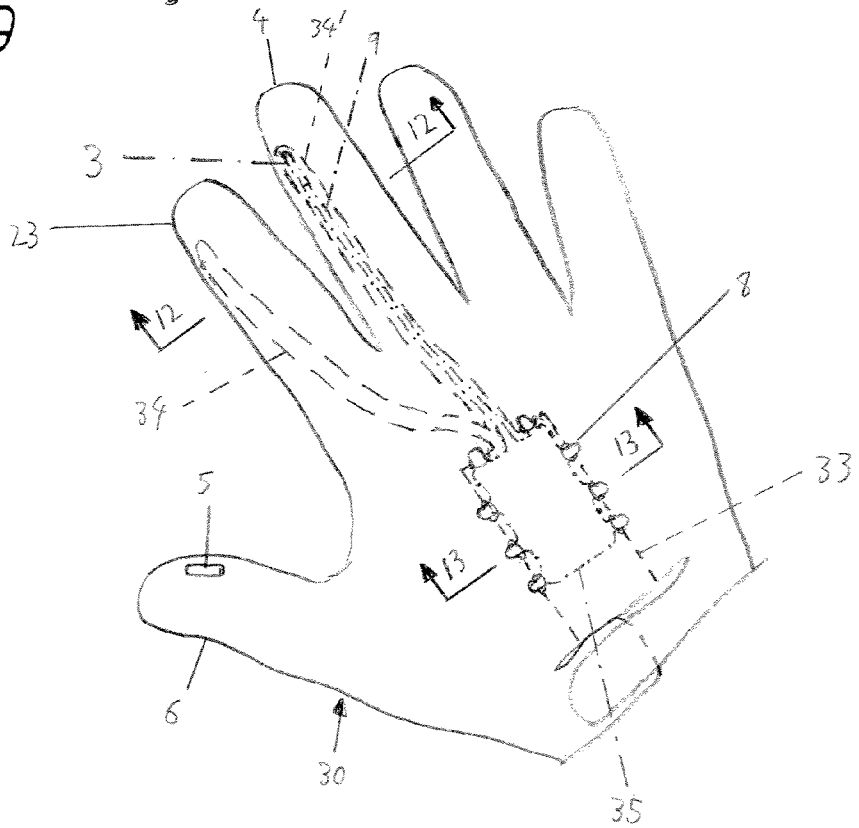
FIG. 9 is a plan view of the glove of FIG. 8 with the illuminating indicating system placed therein.
Figure 10:
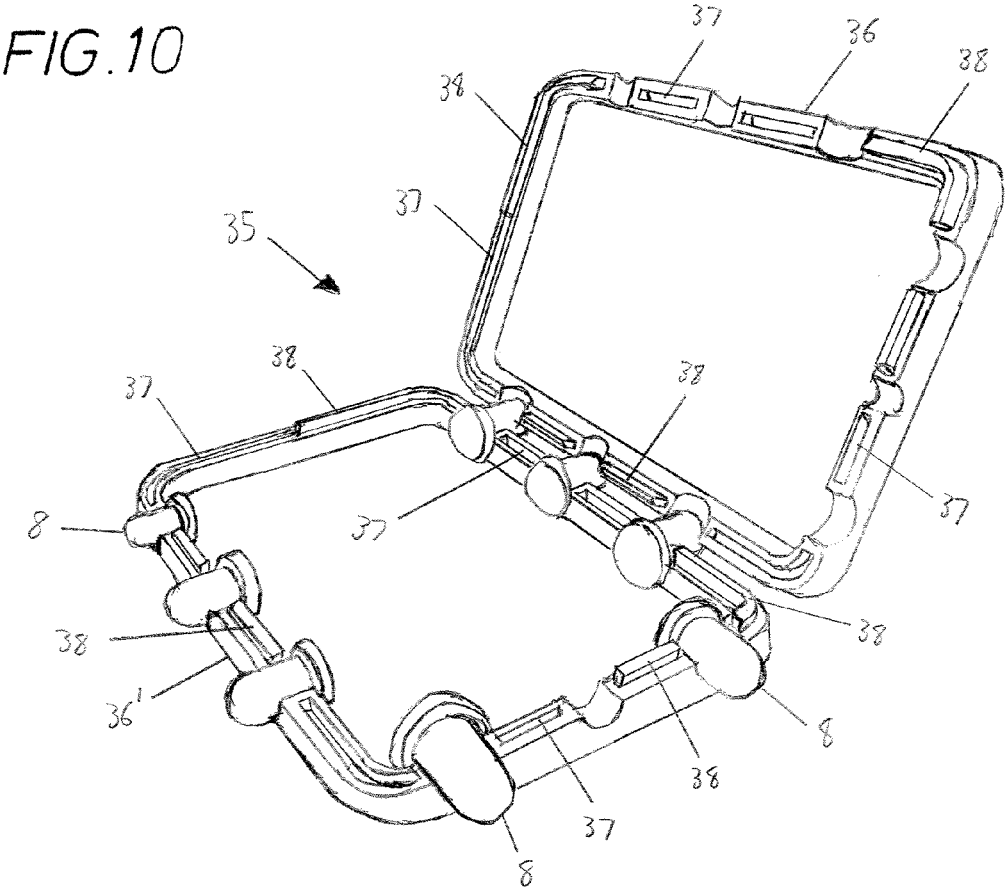
FIGS. 10 and 11 are isometric views of a casing forming part of the illuminating indicating system of FIGS. 8 and 9 with the casing shown open and closed, respectively.
Figure 11:
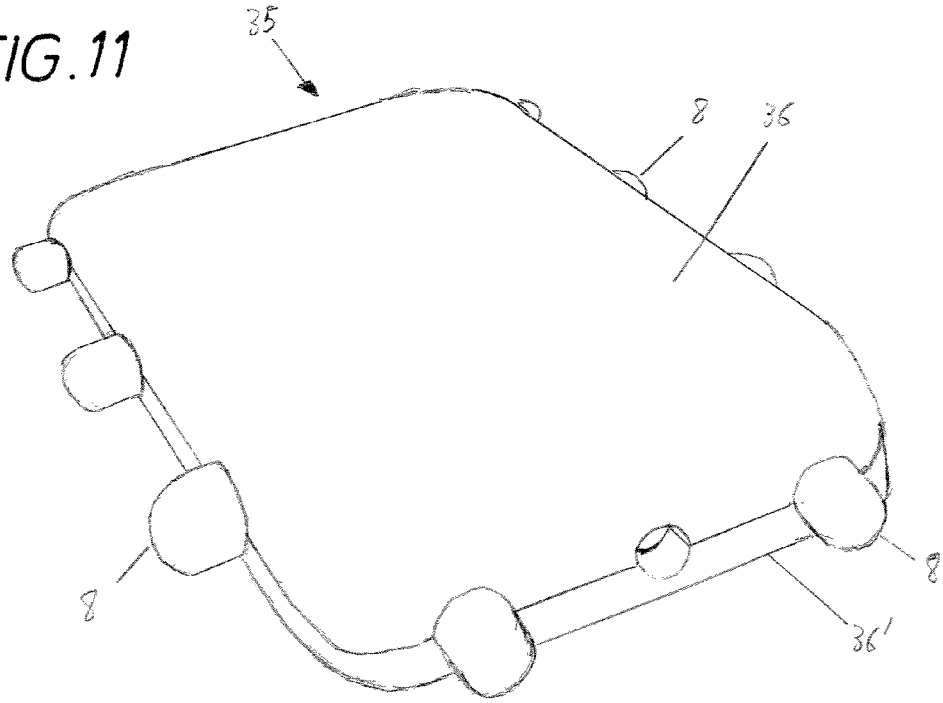
Figure 12:
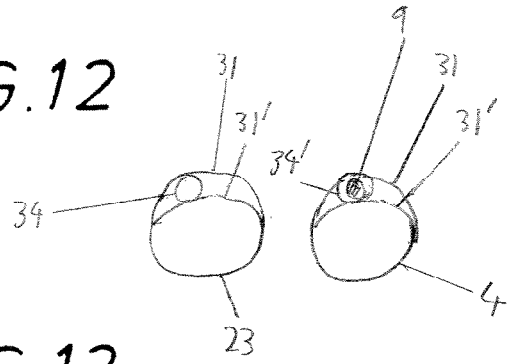
FIGS. 12 and 13 are sectional views taken along lines 12-12 and 13-13, respectively of FIG. 9.
Figure 13:
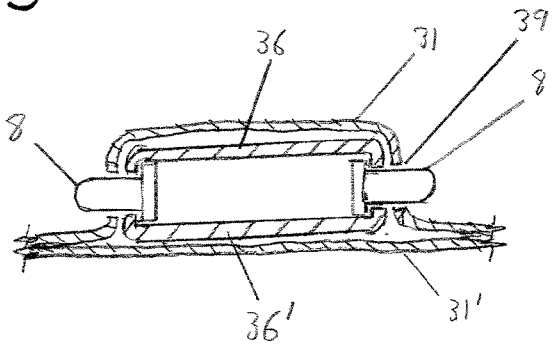

In yet another modification illustrated in FIG. 7, the illuminating indicating system 20 has two reed switches 21, 22 wherein one reed switch 21 is located on the forefinger 23 of the glove 1 and another reed switch 22 is located on the middle finger 4. Each reed switch 21, 22 is connected by respective wiring 24, 25 to the circuit board (not shown) housed in the casing 26. Two sets of LEDs 27, 28 are mounted in the casing 26 wherein one set is to produce red light and the other set is to produce green light. When the user wearing the glove 1 brings his thumb 6 and forefinger 23 towards each other the forefinger reed switch 21 is closed causing the red LEDs 27 to illuminate red light and when the user brings his thumb 6 and middle finger 4 towards each other the middle finger reed switch 22 is closed causing the green LEDs 28 to illuminate green light.

In a further modification illustrated in FIGS. 7 to 13, the glove 30 has a double layer 31, 31' of resilient material for the back of the glove 30 and the back of the fingers. A pocket 33 is formed between the two layers 31, 31' in the back of the glove 30 and the pocket 33 is open at the end 40 where a hand is to be inserted into the glove 30. At the opposite end of the pocket 33 are two conduits, tubes or channels or tether channels 34, 34' formed between the two layers 31, 31' with one conduit 34 extending up towards the end of the forefinger digit 23 of the glove 30 and the other conduit 34' extending up towards the end of the middle finger 4 of the glove 30.

The pocket 33 is arranged to receive the protective casing 35. The protective casing 35 is formed of two portions 36, 36' which each have corresponding tongues 37 and grooves 38 to enable the two portions 36, 36' to fit together. The casing 35 has the LEDs 8 extending from it and the casing 35 houses the circuit board and battery (not shown) wherein the LEDs 8 are connected to the circuit board. The cable connection 9 extends from the circuit board in the casing 35 to the reed switch 3.

The reed switch 3 is inserted into either the forefinger or middle finger conduit 34, 34' depending on the preference of the user (shown in middle finger conduit 34' in FIGS. 9 and 12) and the protective casing 34 is inserted into the pocket 33 so that the LEDs 8 protrude through holes 39 in the outer layer 31 of the back of the glove 30. The resilient nature of the material of the layers 31, 31' ensures that the two portions 36, 36' of the casing 35 are held together. The casing 35 and the connected reed switch 3 are removed from the glove 30 when the glove 30 is to be washed or when the battery is to be changed. For the latter, when the casing 35 is removed its two portions 36, 36' are simply separated in order to replace the battery.

This arrangement provides protection for the electrical elements from water.

Figure 14:
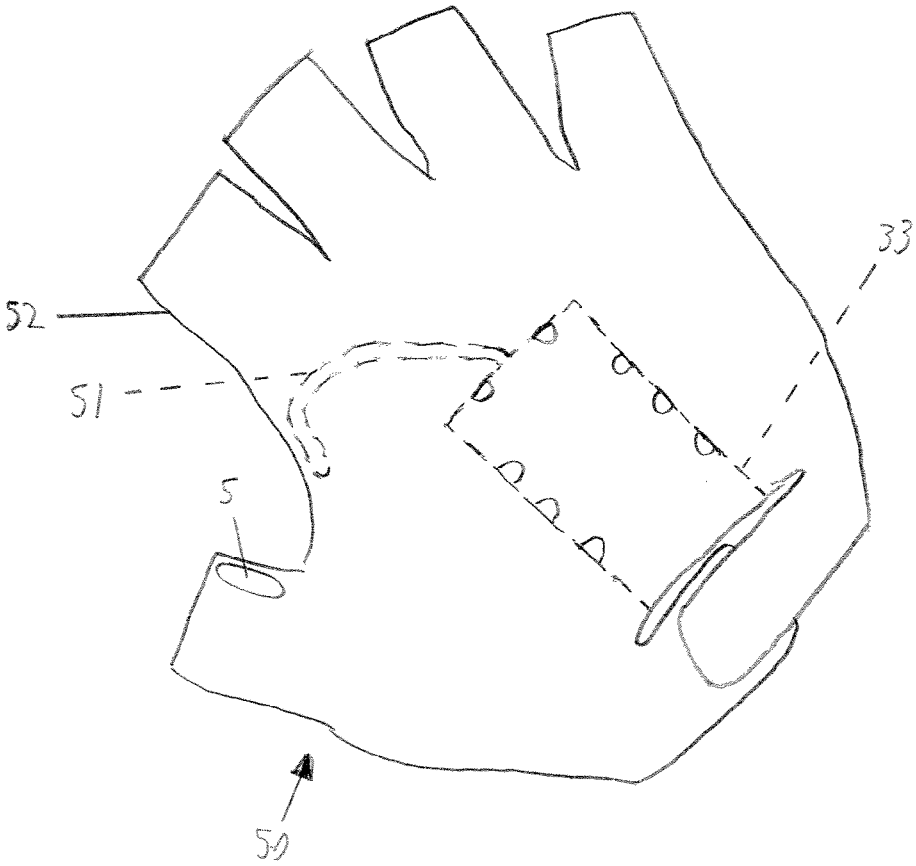
FIG. 14 is a plan view of a short-fingered version of the glove of FIG. 8.

A short-fingered version of the glove 50 of FIGS. 7 to 13 is illustrated in FIG. 14. The glove 50 has one conduit 51 from the pocket 33 and is bent beneath the truncated forefinger digit 52 of the glove 50 so that there is enough length for the reed switch and attached cable (not shown).

Whilst particular embodiments have been described, it will be understood that various modifications may be made without departing from the scope of the invention.

The invention claimed is:

1. A glove including digits and an illuminating indicating system, the system including a proximity switch connected to one digit of the glove, a proximity switch actuator connected to another digit of the glove, and a light source, the system being configured such that bringing the proximity switch and the proximity switch actuator within a threshold distance from each other causes the proximity switch to effect illumination of the light source.

2. The glove as claimed in claim 1, wherein at least part of the illuminating indicating system is removable from the glove.

3. The glove as claimed in claim 2, wherein all of the illuminating indicating system other than the proximity switch actuator is removable from the glove.

4. The glove as claimed in claim 1, including a power source for providing power to illuminate the light source, and a connector connecting the proximity switch to the light source.

5. The glove as claimed in claim 4, wherein the power source, the light source, the proximity switch and the connector form a single unit removably attached to the glove.

6. The glove as claimed in claim 4, including a casing for holding the power source and the light source.

7. The glove as claimed in claim 6, wherein the casing comprises two portions that fit together.

8. The glove as claimed in claim 1, including a pocket which houses at least part of the illuminating indicating system.

9. The glove as claimed in claim 8, wherein the casing comprises two portions that fit together and are held together by the pocket.

10. The glove as claimed in claim 9, wherein the pocket means comprises resilient material enabling the two casing portions to be held together by the pocket when the casing is inserted in the pocket.

11. The glove as claimed in claim 8, wherein the proximity switch is in a conduit in a digit of the glove and the conduit is connected to the pocket.

12. The glove as claimed in claim 1, wherein a plurality of said digits each has a proximity switch or proximity switch actuator holders so that said proximity switch or proximity switch actuator can be held by any one of said holders.

13. The glove as claimed in claim 12, wherein the holders comprises a conduit in a digit of the glove and the conduit is connected to the pocket.

14. The glove as claimed in claim 1, wherein the proximity switch is in a finger of the glove and the proximity switch actuator is connected to the thumb of the glove.

15. The glove as claimed in claim 1, wherein the proximity switch comprises as reed switch and the proximity switch actuator comprises a magnet.

16. The glove as claimed in claim 1, wherein the threshold distance is not more than 5 cm apart.

17. The glove as claimed in claim 1, wherein the proximity switch is releasably connected to one digit of the glove.

18. A glove for use by a wearer for visually signalling others in proximity to the wearer, the glove including digits and an illuminating indicating system, the system including a proximity switch connected to one digit of the glove, a proximity switch actuator connected to another digit of the glove, and a light source, the system being configured such that bringing the proximity switch and the proximity switch actuator within a threshold distance from each other causes the proximity switch to effect illumination of the light source to thereby send a visual signal to others in proximity to the wearer.

* * * * *